US008251610B2

(12) United States Patent
Heselden

(10) Patent No.: US 8,251,610 B2
(45) **Date of Patent: *Aug. 28, 2012**

(54) APPARATUS FOR THE CREATION OF OUTER SURFACES FOR STRUCTURES

(75) Inventor: James Heselden, Leeds (GB)

(73) Assignee: Hesco Bastion Limited, Leeds, Yorkshire (GB)

( * ) Notice: Subject to any disclaimer, the term of this patent is extended or adjusted under 35 U.S.C. 154(b) by 0 days.

This patent is subject to a terminal disclaimer.

(21) Appl. No.: 12/635,832

(22) Filed: Dec. 11, 2009

(65) Prior Publication Data

US 2010/0092251 A1 Apr. 15, 2010

Related U.S. Application Data

(63) Continuation of application No. 12/413,904, filed on Mar. 30, 2009, now abandoned, which is a continuation of application No. 11/958,809, filed on Dec. 18, 2007, now Pat. No. 7,530,763, which is a continuation of application No. 10/597,910, filed as application No. PCT/GB2005/000447 on Feb. 9, 2005, now Pat. No. 7,419,330.

(30) Foreign Application Priority Data

Feb. 12, 2004 (GB) ..... 0403109.2

(51) Int. Cl.
*E02D 29/02* (2006.01)

(52) U.S. Cl. ..... 405/15

(58) Field of Classification Search ..... 405/15, 405/16

See application file for complete search history.

(56) References Cited

U.S. PATENT DOCUMENTS

| | | | | |
|---|---|---|---|---|
| 1,977,040 | A | 10/1934 | Beukers, Jr | |
| 2,121,173 | A | 6/1938 | MacPherson | |
| 4,316,404 | A | 2/1982 | Medlin | |
| 4,498,592 | A | 2/1985 | Colucci | |
| 5,161,917 | A | 11/1992 | Papetti | |
| 5,333,970 | A * | 8/1994 | Heselden | 405/286 |
| 5,368,410 | A | 11/1994 | Ferraiolo et al. | |
| 5,472,297 | A | 12/1995 | Heselden | |

(Continued)

FOREIGN PATENT DOCUMENTS

EP 0466726 B1 11/1995

(Continued)

OTHER PUBLICATIONS

International Search Report; Written Opinion of International Searching Authority, (International Patent Application No. PCT/GB2005/000447, filed Feb. 9, 2005).

*Primary Examiner* — John Kreck

(74) *Attorney, Agent, or Firm* — Ping Wang; Andrews Kurth LLP

(57) ABSTRACT

The present invention provides an apparatus for creating an outer surface effect of a structure wherein at least one wall of the structure defines a support surface, the apparatus comprising means defining a covering surface which overlies the support surface but is movable therefrom, so that a quantity of material to create the outer surface effect can be positioned between the support surface and the covering surface, and wherein the covering surface is in the form of a panel.

16 Claims, 16 Drawing Sheets

U.S. PATENT DOCUMENTS

| | | | |
|---|---|---|---|
| 5,636,938 | A | 6/1997 | Ragazzo |
| 5,647,695 | A | 7/1997 | Hilfiker et al. |
| 5,788,424 | A | 8/1998 | Torch |
| 2003/0145526 | A1 | 8/2003 | Rothfuss |
| 2005/0279394 | A1 | 12/2005 | Leninher et al. |

FOREIGN PATENT DOCUMENTS

| | | | | |
|---|---|---|---|---|
| EP | 0816572 | A2 | | 1/1998 |
| GB | 2332353 | a | * | 6/1999 |
| JP | 200216766 | A | | 12/2000 |
| JP | 2004194609 | A | | 12/2002 |
| JP | 2003155722 | A | * | 5/2003 |
| JP | 2003-232023 | a | * | 8/2003 |
| NL | 1024629 | | | 10/2003 |
| WO | 0040810 | A1 | | 7/2000 |

* cited by examiner

--PRIOR ART--

--PRIOR ART--

--PRIOR ART--

APPARATUS FOR THE CREATION OF OUTER SURFACES FOR STRUCTURES

This application is a continuation application of the U.S. patent application Ser. No. 12/413,904, filed Mar. 30, 2009, which is a continuation application of Ser. No. 11/958,809, filed Dec. 18, 2007, now U.S. Pat. No. 7,530,763, which is a continuation application of the U.S. patent application Ser. No. 10/597,910, filed Aug. 11, 2006, now U.S. Pat. No. 7,419,330, which is a National Stage Entry of International Patent Application No. PCT/GB2005/000447, filed Feb. 9, 2005, filed Feb. 9, 2005, which claims priority to United Kingdom Patent Application No. 0403109.2, filed Feb. 12, 2004. The entirety of all of the aforementioned applications is incorporated herein by reference.

FIELD

This invention relates to apparatus for the creation of outer surfaces having certain effects for structures. In particular, the invention relates to gabion facades and to gabion inserts.

BACKGROUND

In European Patent No. 0466726, there is set forth a cage structure useful in connection with the creation of building blocks, which can be used for sea defences, shoring hillsides, and for providing military defence walls. These structures are made of open mesh panels, for example of welded mesh material, or twisted wire construction. The advantage of the structure set forth is that the panels are used to form the walls of the structure, with the panels being pivotally connected under factory conditions and the structure can be folded to a flat collapsed condition for transportation to site. On site, simply by manipulation, the structure is capable of being moved from the collapsed condition to an erected condition, in which the structure defines a row of open topped cavities which can be filled with soil, sand, rubble or the like to form a wall (or part thereof), shoring block or the like. The invention has been successful commercially on a worldwide basis.

The type of gabion described in EP-B-0466726 has applications in the military field, as well as in civil and environmental defence. Other types of gabion have applications in landscape design and in decorative or aesthetic connections, such as garden ornaments or window boxes. It may be desirable in some circumstances to provide such gabions with a surface effect which allows the gabion fill material to be obscured from view by a surface effect material in use of the gabion.

As well as aesthetic reasons for providing a surface effect, a problem which has been encountered with some gabions is that in certain climates, particularly hot climates, the material which is used to fill the cavities formed by the panels can be susceptible to changing conditions under temperature extremes. For example the material may be caused to contract in cold weather or expand in hot weather which can cause the structure to be less rigid or threaten to "burst" the joins between the panels.

A further problem is that in certain instances it can be desirable to provide a building structure with a particular surface effect, which it might not otherwise have from the material used to fill the cavities.

It should be clear that the invention can be applied to other building structures and situations. This should be borne in mind despite the fact that in the following a structure of the type described in the applicant's patent EP0466726 is given as a particular embodiment of the invention. Other types of gabion are particularly susceptible to improvement with this invention.

In a collapsible/erectable structure it is difficult to give the walls, or one wall a different surface effect than would be achieved as a result of the materials used for the structure and the filling material. It is disclosed in the said patent that when the structure is erected and filled, the walls can be given a different surface effect by the spraying of decorative synthetic resin onto the walls of the erected structure. However, it may be desirable that the walls were to have a different surface effect, say of aesthetically attractive materials such as pebbles, turf or of other vegetation effect, or a surface effect for protective purposes that could not be achieved with the structure specifically described in the said patent.

SUMMARY

The present invention provides an apparatus whereby an outer surface can be provided, which is other than the surface which would be achieved without the invention with the located surface effect being of advantage from an appearance effect and/or in controlling the condition of the building structure.

Accordingly, the present invention provides cage structure comprising opposed side walls connected by opposed end walls defining a cage cavity therebetween, the cage structure being provided on at least one side or end wall with a façade spaced from said side or end wall to an extent sufficient to accommodate a surface effect material between the at least one side or end wall and the façade.

Preferably the façade comprises a material which permits viewing of the surface effect material when thus accommodated.

Also provided is a cage structure comprising opposed side walls connected by opposed end walls defining a cage cavity therebetween, the cage structure being provided on at least one side or end wall with an insert spaced from said side or end wall to an extent sufficient to accommodate a surface effect material between the at least one side or end wall and the insert. Preferably the side or end wall on which the insert is provided comprises a material which permits viewing of the surface effect material when thus accommodated.

The façade or insert may comprise a secondary cage structure comprising opposed side walls connected by opposed end walls defining a cage cavity therebetween.

The cage structure may be in the form of a multi-compartmental gabion comprising pivotally connected side and end walls and at least one pivotally connected partition wall, the at least one partition wall separating individual compartments of the gabion. In this case the façade or insert may comprise a secondary cage structure in the form of a multi-compartmental gabion comprising pivotally connected side and end walls and at least one pivotally connected partition wall, the at least one partition wall separating individual compartments of the gabion.

The cage structure may be provided with a first fill material filled against the façade or against the side or end wall on which the insert is provided, and a second fill material filled behind the first fill material, the second fill material being a different material from the first fill material.

The present invention also provides a cage structure comprising opposed side walls connected by opposed end walls defining a cage cavity therebetween, the cage structure being provided on at least one side or end wall with a façade spaced from said side or end wall to an extent sufficient to accommodate a surface effect material between the at least one side or end wall and the façade, the façade comprising a material which permits viewing of the surface effect material when thus accommodated.

Also according to the present invention there is provided a cage structure comprising opposed side walls connected by opposed end walls defining a cage cavity therebetween, the cage structure being provided on at least one side or end wall with an insert spaced from said side or end wall to an extent sufficient to accommodate a surface effect material between the at least one side or end wall and the insert, the side or end wall on which the insert is provided comprising a material which permits viewing of the surface effect material when thus accommodated.

It will therefore be seen that the invention permits the adaptation of a gabion structure to provide a surface effect by blocking or partially blocking through at least one side or end wall of the gabion viewing of a gabion fill material located in the gabion by interposing between the viewer and the gabion fill material a surface effect material accommodated either on the outside of the said side or end wall (and retained in place by the façade) or on the inside of the said side or end wall (and retained in place by the insert).

The façade may for example comprise a mesh material which permits viewing of the accommodated surface effect material through the mesh holes. Alternatively, the façade may comprise a transparent material—such as glass, acrylic or Perspex™ for example.

In the case of an insert, the side or end wall on which the insert is provided preferably comprises a mesh material which permits viewing of the accommodated surface effect material through the mesh holes.

If the surface effect material has a technical function rather than an aesthetic function, it is not necessary for the surface effect material to be viewable from the outside. Thus, if the surface effect material has anti-corrosive properties, for example, the façade or the side or end wall on which the insert is provided may be opaque The façade or insert is preferably connected to the side or end wall on which it is provided, or may be connected either side of said side or end wall to neighbouring pairs of side, end walls. In the case of a multi-compartmental gabion, an insert may alternatively (or also) be connected to one or more partition walls neighbouring the side wall on which the insert is provided (partition walls in this case being the walls dividing compartments of a multi-compartmental gabion)

Such connection is preferably achieved by suitable mechanical means, for example one or more connectors, clips, ties or fasteners.

The connection, particularly in the case of a façade, may be removable. That is to say, the connector(s), clip(s) tie(s) or fastener(s) may be releasable or removable to allow detachment, or partial detachment, of the façade or insert. Such connection may be pivotal (one edge of the façade or insert being pivotally connected to a corresponding edge of the side or end wall, for example), or the façade or insert may be completely removeable from the side or end wall.

In accordance with the invention there is provided an apparatus for creating an outer surface of a structure wherein at least one wall of the structure defines a support surface, the apparatus comprising means defining a covering surface which overlies the support surface but is movable therefrom, so that a quantity of material to create the outer surface can be positioned between the support surface and the covering surface, and wherein the covering surface is in the form of a panel. When the surface effect material has an aesthetic quality. Typically the panel is a mesh panel or transparent panel through which the said surface effect material can be viewed.

In accordance with the invention there is provided an apparatus for creating an outer surface of a structure wherein at least one wall of the structure defines a support surface, the apparatus comprising means defining a covering surface which overlies the support surface but is movable therefrom, so that a quantity of material to create the outer surface can be positioned between the support surface and the covering surface, and wherein the covering surface is in the form of a panel. Typically the panel is a mesh panel or transparent panel through which the said surface affect material can be viewed.

Preferably, the support surface is defined by a mesh panel, and the edges of the cover panel are connected to the edges of the support mesh panel by means of suitable connectors. Suitable connectors may be in the form of elongated, coiled wire connectors threaded round the edges of the mesh panels at a pair of opposite edges of such panels, or threaded about intermediate spacing panels which serve to space the outer panels from the support of the structure.

Preferably, the structure is defined by a series of mesh panels, and the edges of the cover panel are connected to the edges of the support mesh panel by means of elongated, coiled wire connectors threaded round the edges of the mesh panels at a pair of opposite edges of such panels, or threaded about intermediate spacing panels which serve to space the outer panels from the support of the structure.

In one embodiment, the cover panels can be pivoted away from the support panel, or be removed therefrom to a sufficient extent to allow a cavity to be formed for the reception of the material to create the outer surface. The material can for example be a layer of turf or other horticultural vegetation, or decorative wood planks, board, or wooden fencing members (such as chestnut fencing poles), rocks, boulders, gravel to be placed on the support panel, or within the cavity. The cover panel can if required be positioned to retain the said material and again if required be connected, by re-threading the coiled wire connector through the edges of the cover and support panels, to trap the material in position between the panels.

The cover panel may be detached completely by removing both coiled wire connectors, or if the cover panel is mounted so as to lie spaced from the support panel to a sufficient extent, then the material may be positioned between the panels without removing the cover panel.

The support panel may be a wall panel of a collapsible structure as described above. Indeed, and as can be expected, all of the wall panels of one or both sides of such a structure may be provided with a surface effect as set for the above. The outer surfaces for the individual wall panels will usually be the same, but they could be different as desired. The invention also extends to a structure as described above, but wherein the various panels, or at least some of them are delivered to site, and the structure is erected on site by connecting the panels together, the outer surface being added after erection of the structure, or in an alternative arrangement, each support panel and its cover panel may be pre-connected and constructed to receive the material to form the outer surface therebetween.

Where the outer surface is created by growing material, this may eventually grow to such an extent as to conceal the cover panel mesh, and so using the collapsible structures mentioned above, could provide a quick means of erecting say a grassy bank, or a boundary hedge wall, which would have a natural look, without the need for any excavation. The invention therefore has considerable advantages. The invention may also have advantages in garden and landscape design, allowing the erection of structures having pleasing outer surface effects created with minimal use of an outer surface effect material.

A further advantage is that by selecting the appropriate material to form the outer surface, so heat insulation can be achieved by the said material thereby preventing adverse effects from the heat on the structure or the filling material or on other items adjacent the structure.

Typically, each or selected sides of the structure can be provided with the panels thereby allowing an outer surface to be created on all or selected sides of the structure. In addition, the material used to form the outer surface can also be positioned on the top of the structure to form an outer surface thereon.

In a further aspect of the invention there is provided a structure comprising a series of interconnected side panels forming a cavity for the reception of filling material therein to form a building structure having opposing side walls and end walls and wherein additional panels are provided along at least the side walls, externally thereof and joined to the same but spaced apart to form respective first and second cavities for the reception of material which differs to the filling material and form outer surfaces along at least the side walls.

In one embodiment the material used has better insulating characteristics than the filling material.

By way of explanation, an embodiment of the invention, with modifications, is illustrated in the accompanying diagrammatic drawings, and is explained in the description which follows.

DETAILED DESCRIPTION

Method to Execute the Invention

Figure 1:
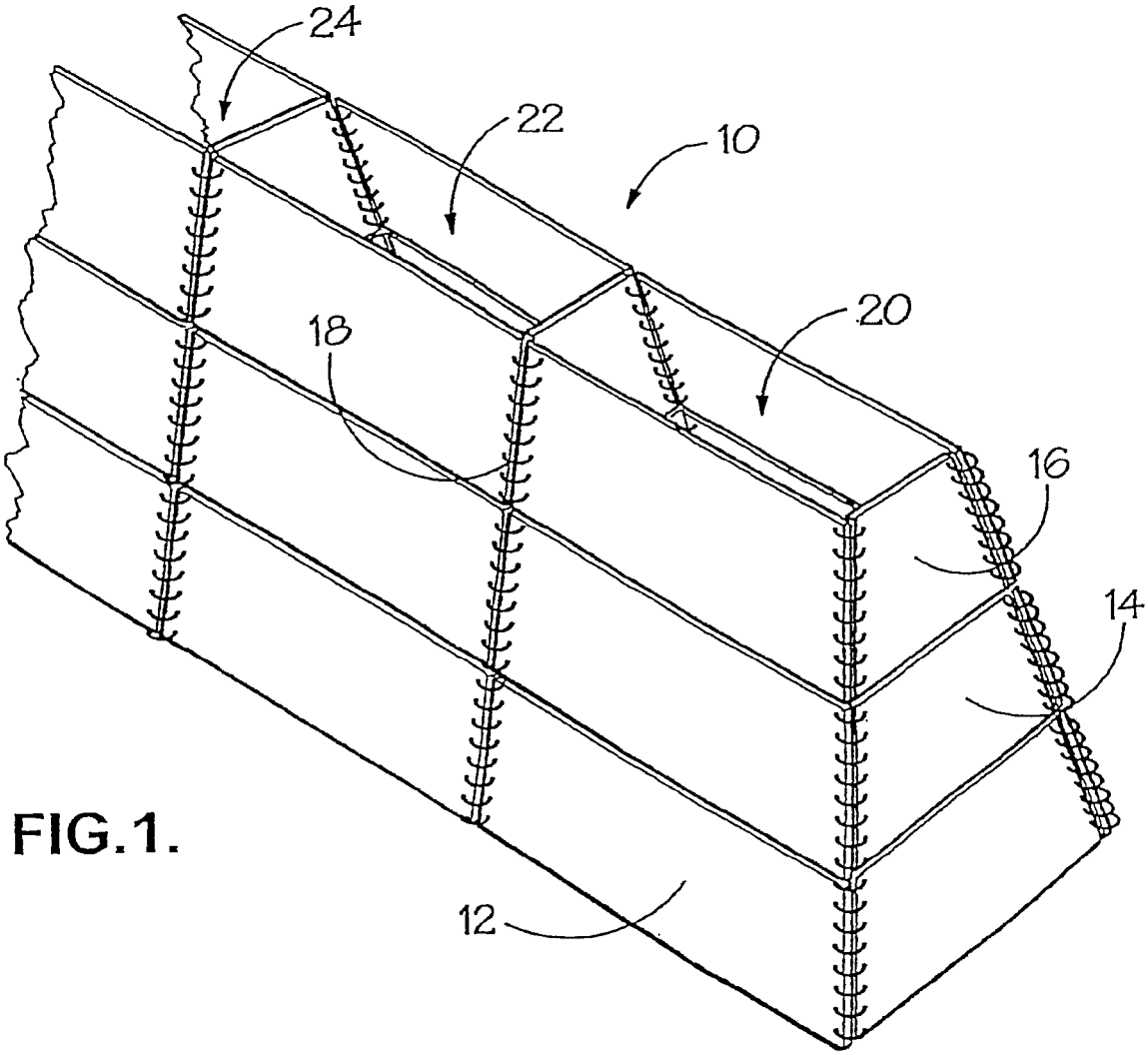
FIG. 1 shows in perspective view, a wall created by collapsible/erectable structures as described herein.

In FIG. 1, a wall 10 is made up of three conventional collapsible/erectable structures of the type described herein and superimposed one upon the other as shown. The structures are illustrated by the reference numerals 12, 14 and 16. In this example the structures are of trapezoidal cross-section so that the bottom one 12 is the broadest, whilst the top one 16 is the narrowest. The structures are made up of panels as described, and these panels are interconnected by means of coiled wire connectors 18, in known manner.

The structures 12, 14 and 16 have no top or bottom, so that each defines a row of cavities 20, 22, 24 and so on, and the structures can be of any appropriate length. Typically, the structure may be of 10 cavity lengths but this is not to be considered as limiting.

In a practical example, the inner surfaces of the panels of the structures 12, 14 and 16 are lined with a retaining material such as a geo-textile material so that when the structure cavities 20, 22 and 24 are filled with appropriate filling material such as soil, sand, rocks or other ballast, that material will not pass through the meshes of the panels, it being remembered that the panels making up the structure will normally be of welded mesh construction.

These structures and the features described are of course already known.

Figure 2:
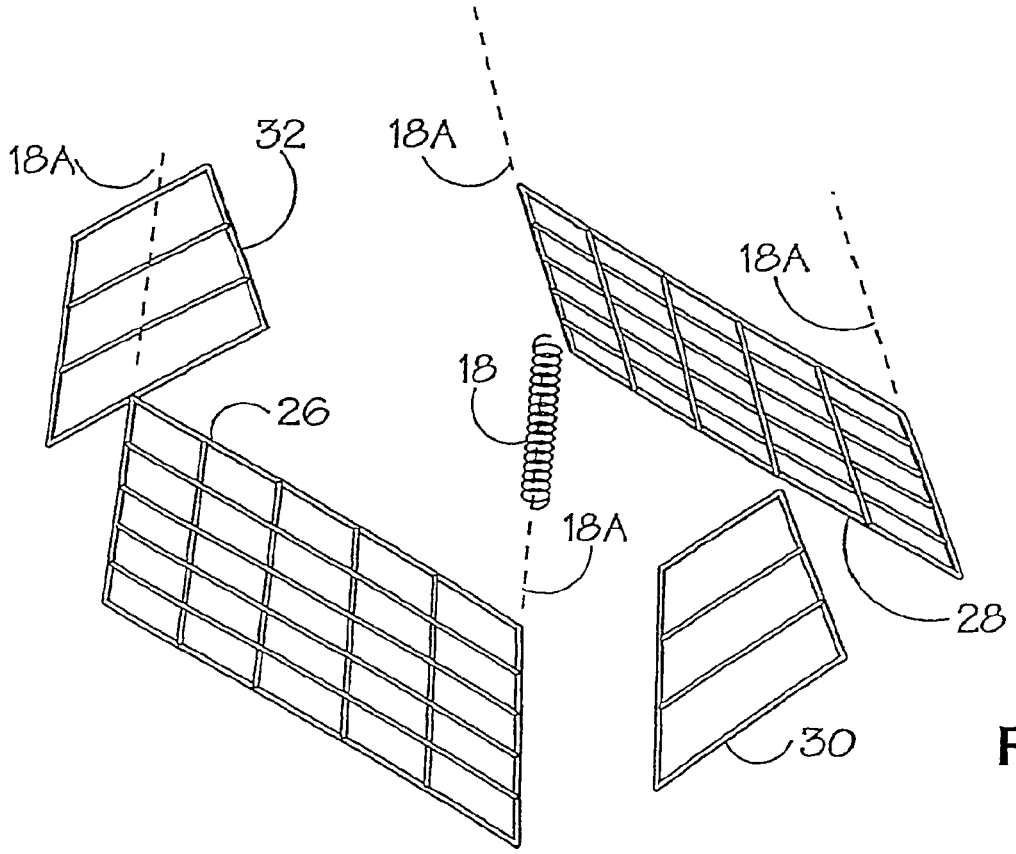
FIG. 2 is an exploded perspective view of the parts defining one cavity of one of the structures shown in FIG. 1.

FIG. 2 shows typically how the panels are used in each structure to form one cavity of the structure. In FIG. 2 the panels shown form the cavity 20 of the top structure 16, and the panels comprise two similar mesh external side panels 26 and 28 formed from a regular grid of regularly spaced apart vertical bars and horizontal bars, including terminal top and bottom horizontal bars and terminal left and right vertical bars, the frame having an inner face and an outer face, and two end panels 30 and 32, which comprise trapezoidal rod boundaries and intermediate parallel connecting rods, although this is still considered to be a mesh structure. Although shown in a trapezoidal form it should be appreciated that the structures can be cube or cuboid in shape, or any other suitable shape. The panels 26 to 32 are connected by means of the coiled wire connectors 18, one of which is shown in greater detail in FIG. 2, but each of the axes 18A represents the position of one of these connectors. To connect the panels shown in FIG. 2, they are brought into the trapezoidal configuration shown in FIG. 1, and then the connectors 18 are spirally wound about the adjacent end bars of the panels so that each connector 18 embraces two bars of the respective adjacent panel edges. By this means, the panels are all pivotally connected together, and having regard to the diameter of the connector 18, so there is a relatively free pivotal movement and there is a certain amount of clearance so, that the panel edges are free to move within the connectors. As shown in FIG. 2, each connector 18 comprises at least two complete rotations of the coil, each rotation of the coil constituting a connecting means, the connector 18 therefore comprising at least two vertically spaced apart connecting means mounted on each of the left and right vertical bars so as to be disposed substantially coplanar with the frame, the connecting means being of substantially uniform length, the vertical spacing between each rotation of the coil being at least twice the length of the connecting means.

Of the panels 30 and 32, if the panel 30 is at the end of a structure, it will be an end panel, but panel 32 will be common to the next cavity, and it is commonly known as a partition panel. The spiral connectors which connect panels 26 and 28 to panel 32 therefore also simultaneously embrace the next adjacent side panels of the next cavity, and so on.

Figure 3:
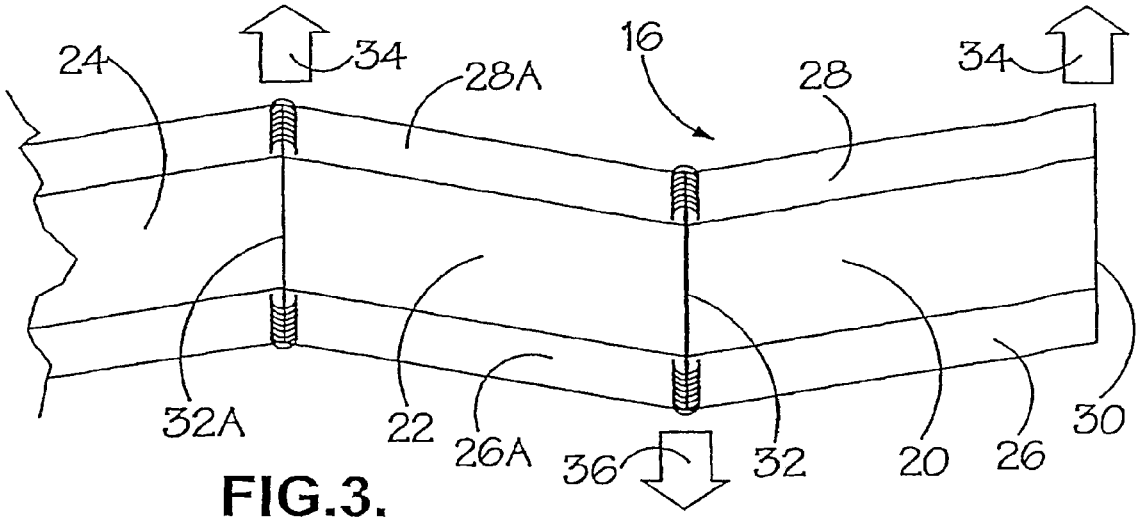
FIG. 3 is an elevation view of one of the structures of FIG. 1, to show how it can be folded to the collapsed position.

It will be understood that the structures depicted in FIG. 1 is therefore foldable by relative pivoting between the various panels, and FIG. 3 is included to show how the structures can be folded. FIG. 3 shows the top structure 16, and the additional panels making up cavity 22 are indicated by reference numerals 26A, 28A and 32A. To collapse the structure the alternate partition panels 30 and 32A are moved in opposite directions as indicated by the arrows 34 and 36 and so the whole structure can fold up zigzag or concertina fashion. Although the partition panels 32 and the end panels 30 are of trapezoidal form, there is sufficient clearance within the coil connectors 18 to allow complete folding to take place. Each of the structures 12, 14 and 16 is collapsible in the same way, and therefore can be folded up for transportation purposes.

The structures 12, 14 and 16 need not be of trapezoidal form, but this form is of particular advantage in relation to the utilisation of the present invention.

Figure 4:
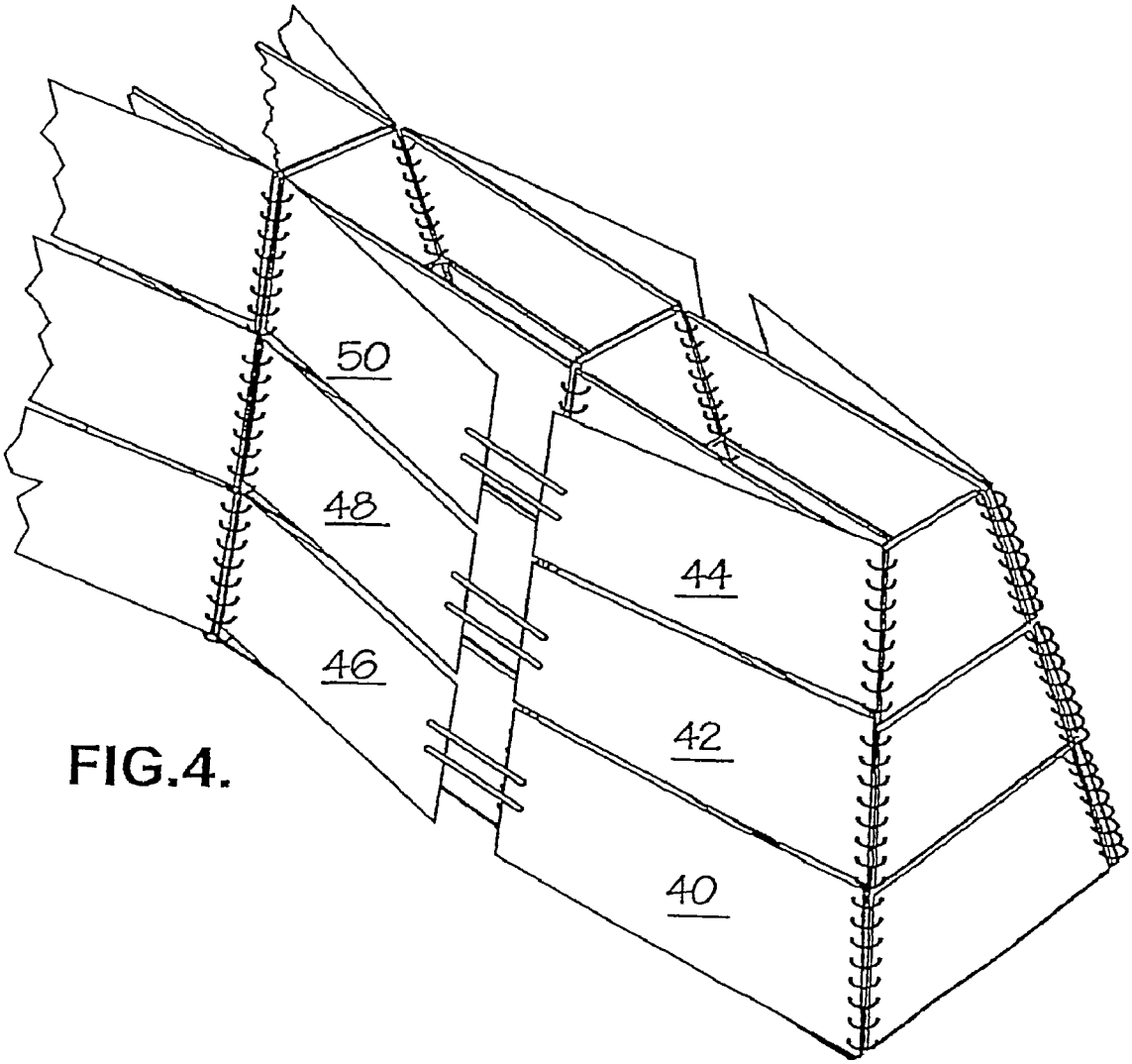
FIG. 4 is a perspective view of the wall of FIG. 1, but showing the cover panels attached to form a structure according to the embodiment of the invention.

In the present invention, the outer surfaces of the panels of the structures shown in FIG. 1 are provided to receive material to form an outer surface to give the overall wall the appearance of having a surface of a material which is different from that which is typically placed in the cavity 20, 22, 24. Referring to FIG. 4, one embodiment is shown and in this embodiment, additional cover panels 40 to 50 are connected to the side panels of the structures as shown. These panels 40 to 50 are connected to the panels using the same connector coils 18 or in a modification, separate connector coils, and the coils connect so that the panels 40 to 50 are pivotable by virtue of being connected to these coils.

Figure 6:
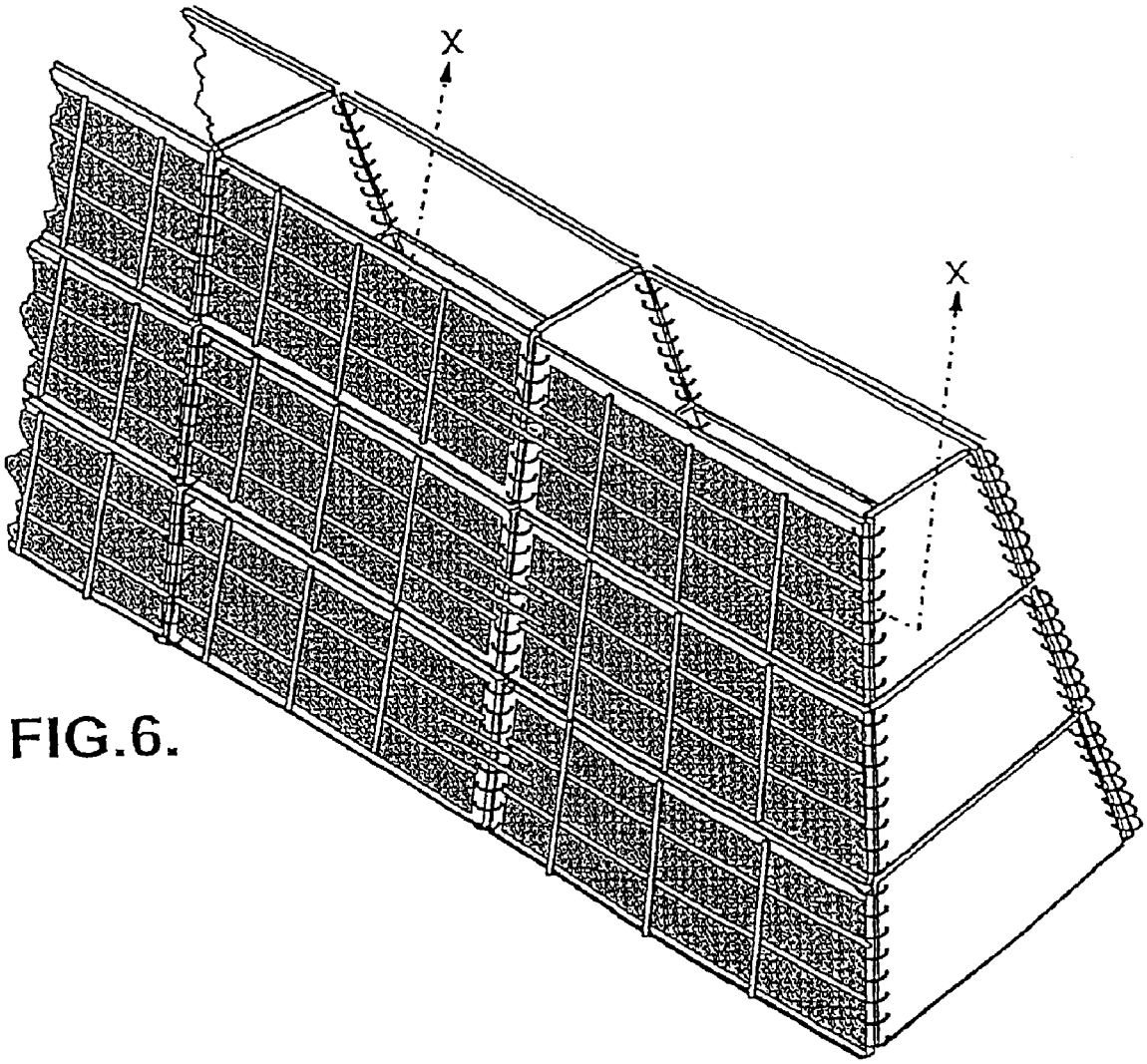
FIG. 6 is a view similar to FIG. 4, but showing the wall with the surface effect layers in position.
Figure 14A:
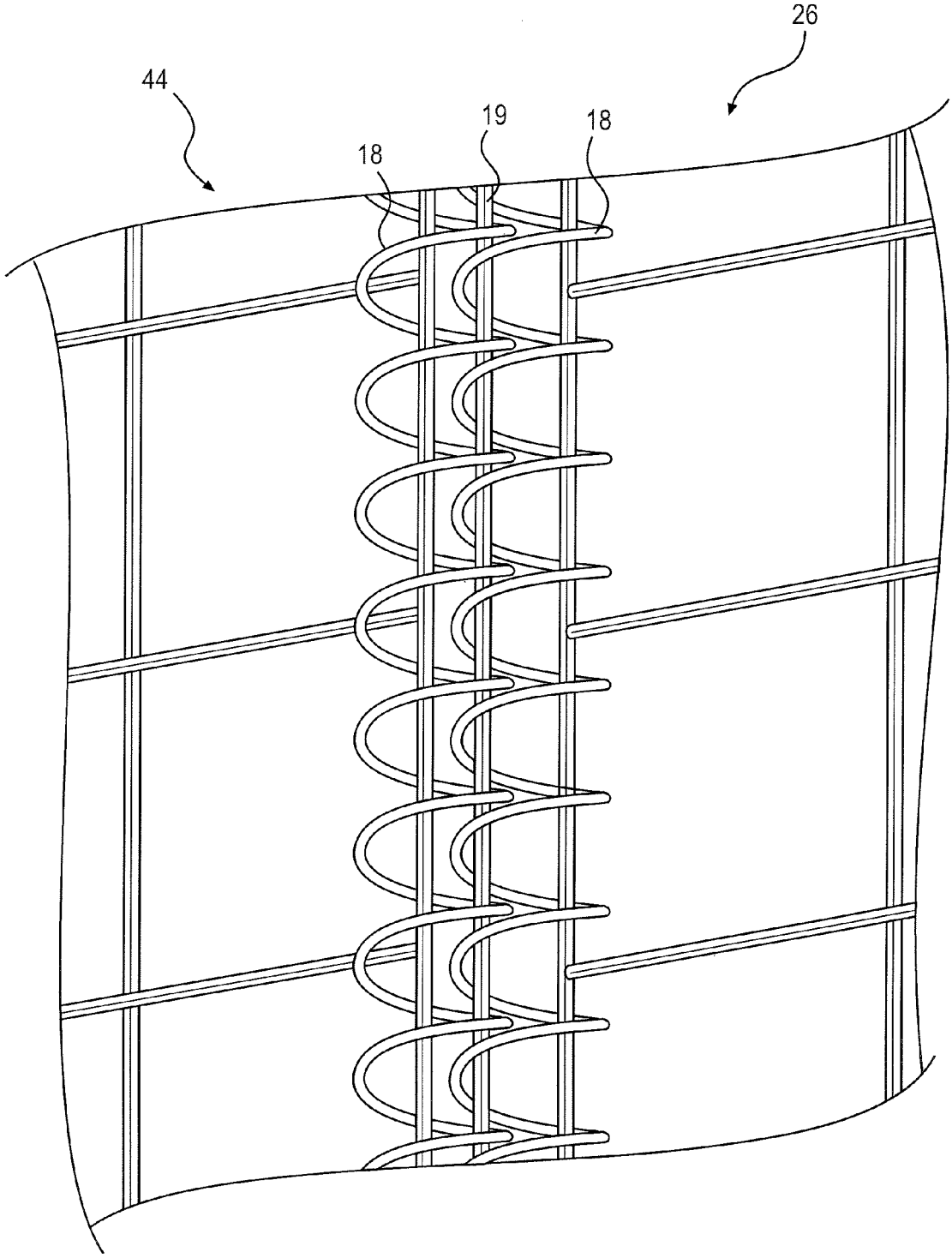
FIGS. 14A-B show coiled connectors attached to panels and moved sufficiently close so that the coils overlap and having a connecting rod inserted through the two coil connectors in views from the side (A) and top (B) of the structure.
Figure 14B:
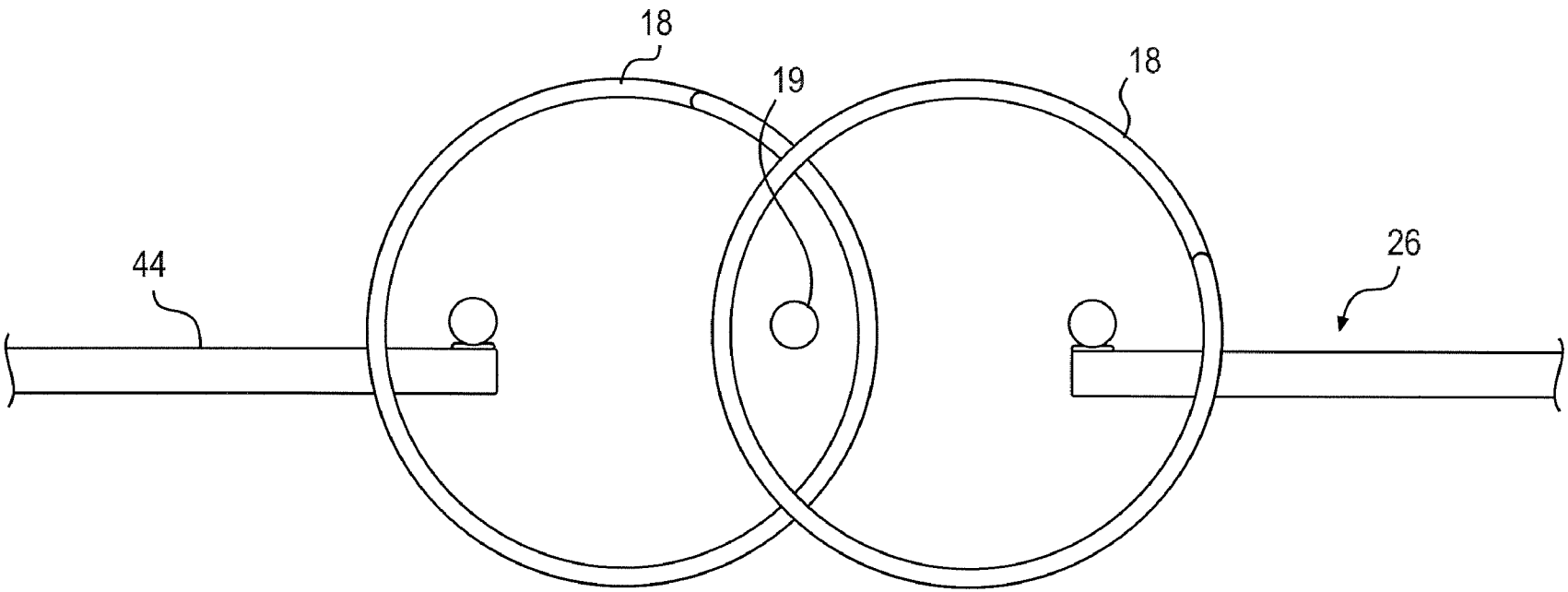

In order to provide the material to form the outer surface of the structure the panels 40 to 50 are pivoted clear of the side panels of the structures 12, 14 and 16, which side panels form support panels and the material can either be applied over the support panels as shown or placed into cavities defined between the support panels and cover panels. When the material is applied, the cover panels 40 to 50 are pivoted back onto the material, and are connected to each other by means of a coiled wire connector such as 18 at the free edges which are shown in FIG. 4 and which meet when the cover panels are placed into position. The coiled wire connectors which connect panels 40 and 46, 42 and 48, and 44 and 50, may be coupled to the existing coiled wire connectors connecting the structure side panels by the insertion of a connecting rod through the two coiled connectors which are moved sufficiently close so that the coils overlap, thereby trapping the surface effect material which is viewable through the panels 40 to 50 as these panels also are of mesh construction. As shown in FIG. 14A in a side view and FIG. 14B in a view from the top, the connecting means 18 on the terminal left vertical bar is vertically indexed a predetermined distance, relative to the connecting means 18 on the terminal right vertical bar, so as to enable two such external panels to be disposed adjacent to one another. The connecting means 18 of one external panel 44 is interdigitated and vetically alligned with the connecting means 18 of the adjacent external panel 26. Adjacent disposition of the panels enables a connecting rod or pin 19 to be passed through the interdigitated connecting means to releasably fasten the external panels to one another. The effect is in fact shown in FIG. 6, where the dashed line areas are intended to represent material which in this embodiment is turf, so that the wall eventually will have a turf surface appearance. This is applied over the whole of the wall surface.

Instead of placing turf between the support and cover mesh panels, other suitable horticultural material can be used such as the material known as "seedam" which is a material which is supplied as a thin layer and in rolls, and is simply unrolled and placed on the ground. The layer comprises soil bound by means of a woven fabric, and the soil contains a seed material from which green vegetation grows.

Figure 8:
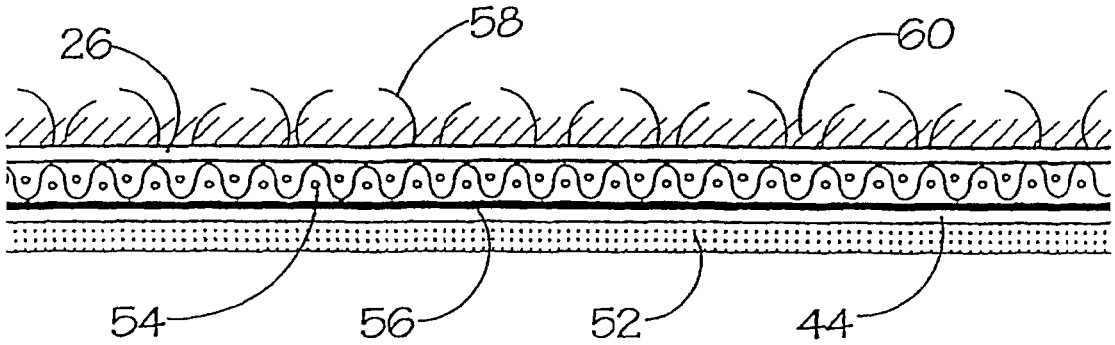
FIG. 8 is a cross sectional view taken on the line X-X in FIG. 6, showing the support mesh, the cover mesh panel and the surface effect layer.

FIG. 8 is included to show a section of this material, and in this figure the growing material is indicated at 52 as it grows through the cover panel 44, and the support panel 26 is also illustrated. Between the support panel and the cover panel is the fabric 54 which forms the binding for the material, and also illustrated is the soil layer 56. The Seedam material has roots which grow rearwards, and these are shown at 58 where they pass through the geo-textile material 60 on the inner side of support panel 26.

The Seedam material is so constructed that the soil and binding fabric will retain moisture enabling the vegetation 52 to grow efficiently, but the addition of the geo-textile material 60 provides a further means for the retention of moisture, and the invention therefore is of particular relevance to the effective growing of the Seedam material. The Seedam material provides an excellent green covering and growth is limited as compared for example to grass so that cutting of the Seedam material is not necessary and therefore it is particularly suitable for this application.

Instead of the panels 40 to 50 being pivotally mounted as shown in FIG. 4, they can be detachably mounted and the material for the outer surface can be mounted on the panels 40 to 50 and then the panels and the material applied as appropriate.

Figure 5:
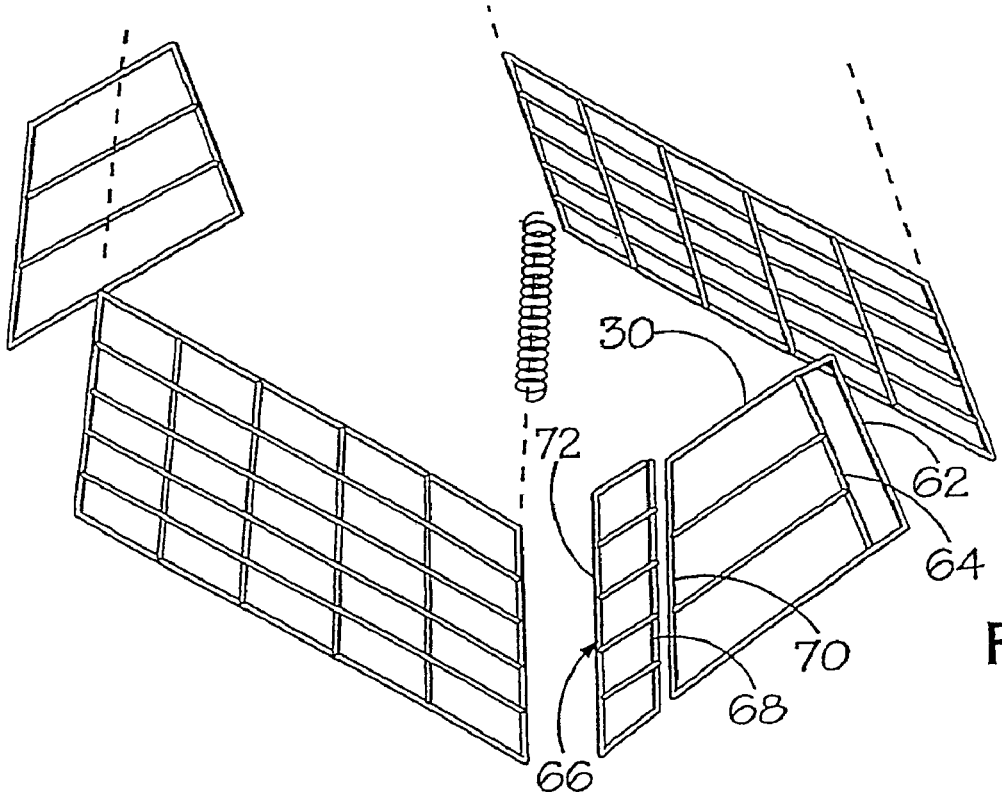
FIG. 5 is a view similar to FIG. 2, but shows a modification.

If reference is made to FIG. 5, modifications are shown therein to the end panel 30. At one side end panel is shown as having an extension wing 62 which forms a connecting bar for the coiled connectors. If the bar 62 is used for example for mounting the cover panels 40 to 50, then these panels 40 to 50 will be spaced slightly further from the support panels of the structures so that thicker surface effect layers can be positioned between the panels. In this case the structure panel would be connected to rod portion 64, and the cover panel would be connected to rod portion 62.

Another modification shown in FIG. 5 is indicated that the opposite side of panel 30 and comprises an extension ladder 66. One rail 68 of that ladder would be coupled to the end panel rod portion 70 by a coiled connector, whilst the other rail 72 serves for the mounting of the cover panel. If either of these modifications is adopted, it would be adopted on each of the end and partition panels of the foldable structure.

Figure 7:
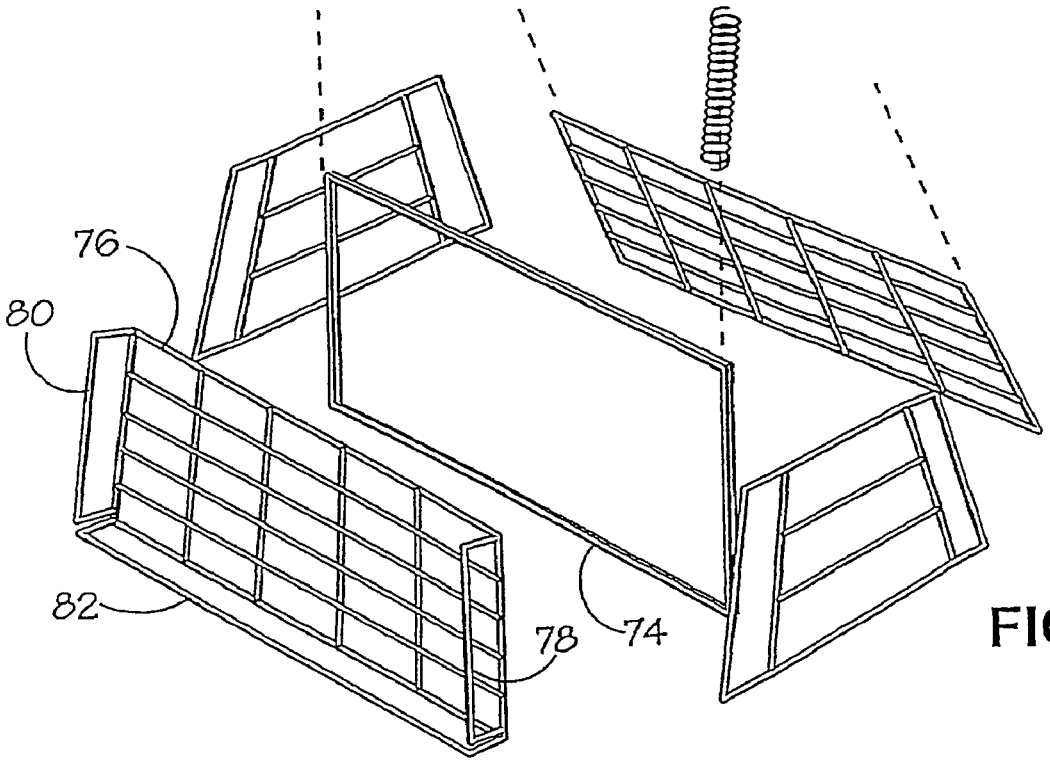
FIG. 7 is a view similar to FIG. 2, but showing a further modification.

Another modification of this character is shown in FIG. 7 where the side panels 26 and 28 are replaced by a frame 74, which serves to receive a mesh tray 76. The tray 76 has a mesh base and rod extension sides 78 and 80 and a base extension 82 of the form shown. The structure is built using the side panels 74, and when it is erected into a wall, the tray 76 is fitted for the receipt of the surface effect material which can be quite thick having regard to the height of the extensions 78 and 82. After the tray is fitted, and the surface effect material is inserted, a cover panel such as 40 to 50 is applied over the tray to retain the surface effect material. All or one or more of the side panels of the structures 12 to 16 may be constructed in this way.

Figure 9:
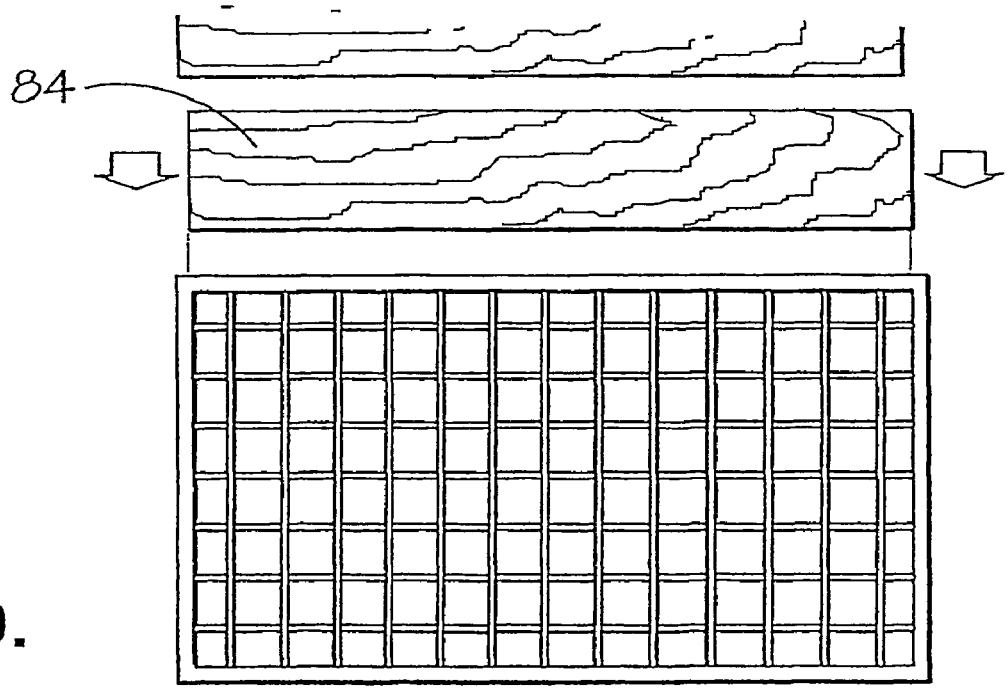
FIGS. 9 and 10 respectively are views to show two of the many different types of surface effect layer which can be used.
Figure 10:
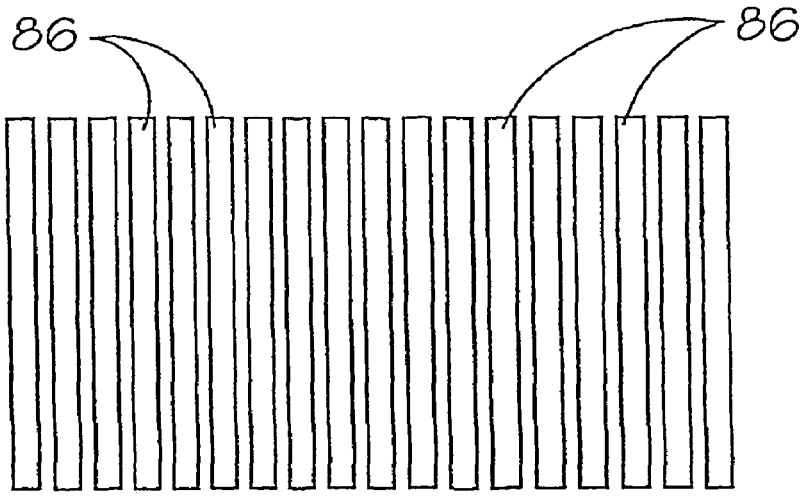

FIGS. 9 and 10 show how solid material may be used to form the outer surface and these are preferably used where the spacing between the support and cover panels is sufficient and these panels are held in spaced relationship.

In FIG. 9 it is shown that wooden planks 84 may be dropped in behind the cover panels or may be placed in the tray 76 of FIG. 7, whilst FIG. 10 shows that chestnut-fencing posts 86 may be used for creating the surface effect. In another arrangement, the surface effect is created by one or more metal plates.

Figure 11:
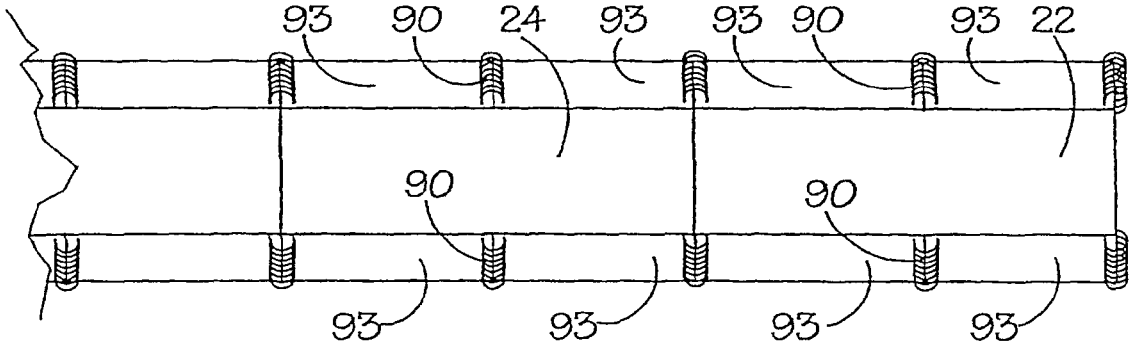
FIG. 11 is a plan view of a collapsible/erectable structure of a different type which can be used.
Figure 12:
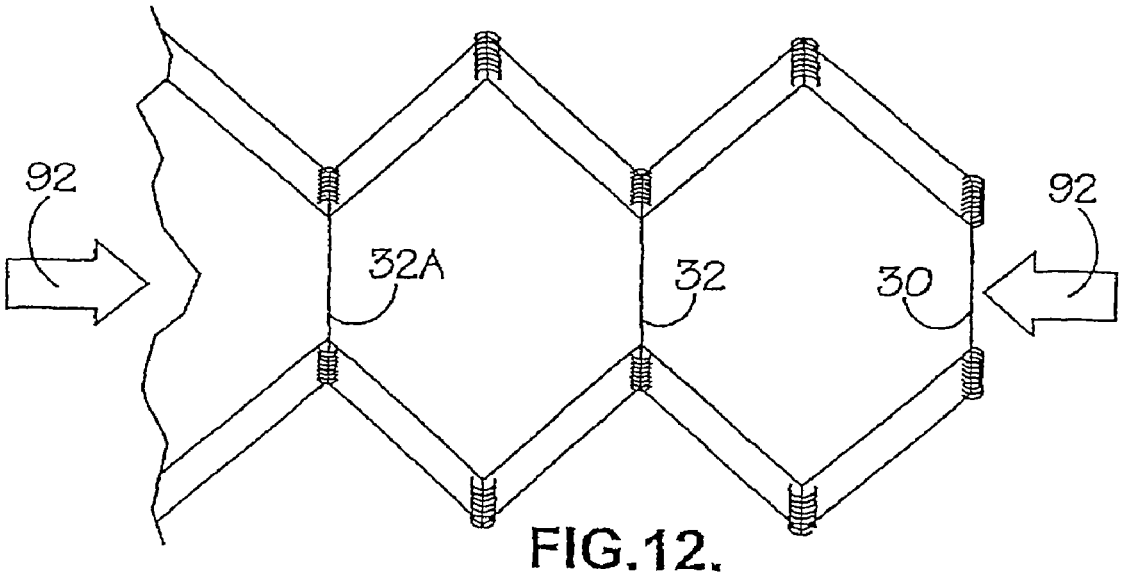
FIG. 12 is a plan of the structure shown in FIG. 11, to illustrate how it can be folded to the collapsed condition.

FIGS. 11 and 12 are included to show that collapsible/erectable structures in accordance with the invention may be of a different configuration from that shown in FIGS. 4 to 10. In the arrangement of FIG. 11, additional pivot connections are provided at 90 in each side of the structure. These pivot connections are parallel to the other pivot connections on that side of the structure and again is created by a coiled wire connector. Each side of each cavity therefore is split into two equal sections which can pivot relative to one another during the collapsing and erecting operations of the structure.

FIG. 12 shows how the structure can be collapsed by pivoting the side sections outwardly so that the partition panels 30, 32, 32A and so on move together in the direction of the arrows 92 as shown in FIG. 12. In this arrangement material can be placed into the cavities 93 when the structure is in the erected condition shown in FIG. 11, with the material placed therein forming the outer surface of the structure on both elongate side walls of the structure. For example, if it is desired that the outer surface which is formed has insulating properties, and then material with such properties which are better than the material used to fill the main cavities 22, 24 and so on can be used to fill the cavities 93 and hence provide the insulating outer surface. Such material could be rocks or the like and which therefore serve to insulate the structure as a whole. Furthermore, if required, the material used to form the outer surface of the elongate side walls can also be used to form the outer surfaces of the end walls of the structure in cavities formed therein, in the same manner by the addition of the panels and/or the top of the structure by placing and, if necessary, securing the insulating material in position, and even the base of the structure by placing said material onto the surface prior to placing the structure thereon and then filling the same.

Figure 13A:
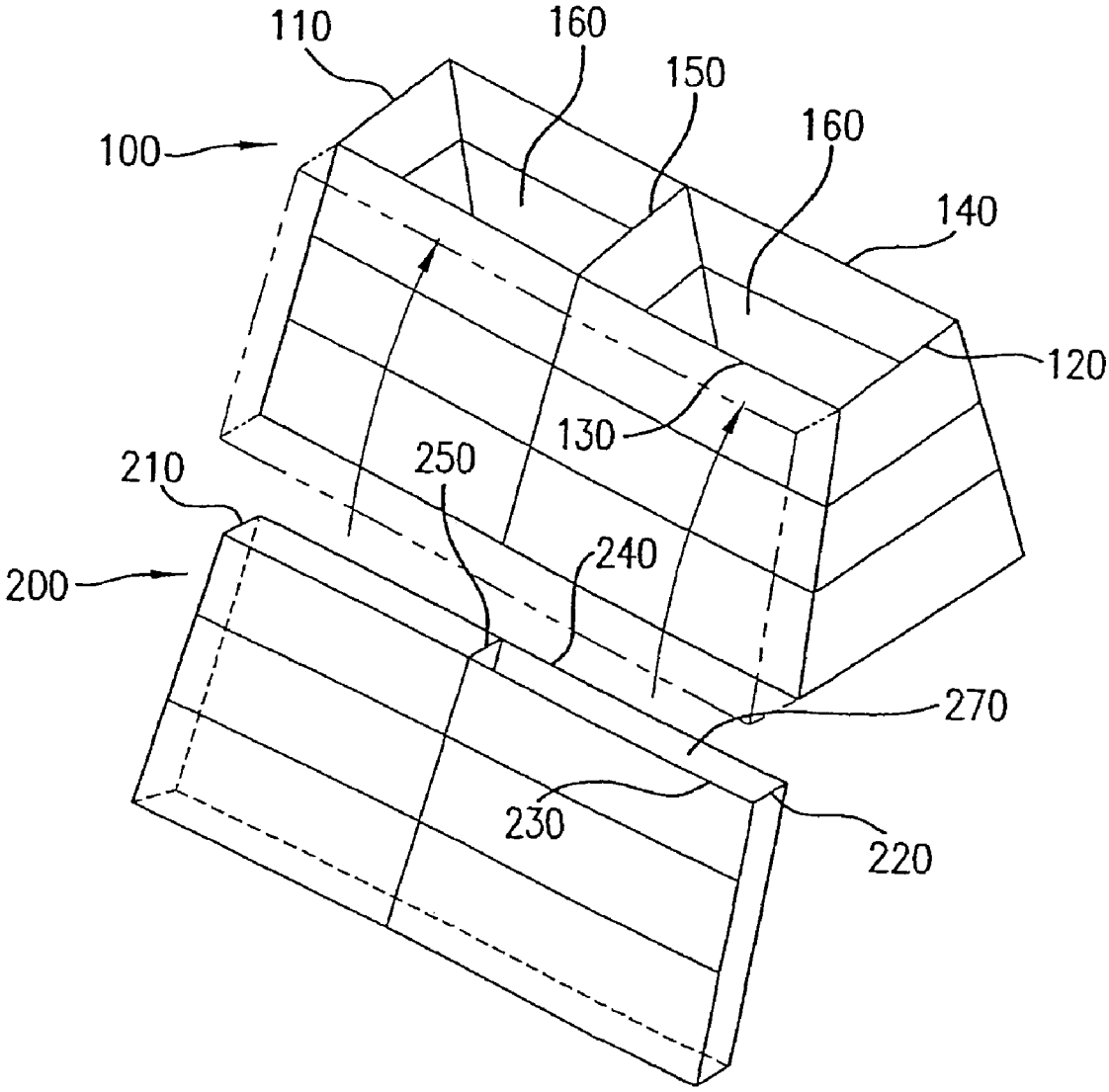
FIG. 13A shows, in perspective view, a multi-compartmental cage structure with a façade.

Another modification shown in FIG. 13A provides a multi-compartmental cage structure 100 comprising opposed side walls 110 and 120 connected by opposed end walls 130 and 140 and at least one pivotally connected partition wall 150. The at least one partition wall 150 separating individual compartments 160 of the cage 100. The cage structure 100 further comprises a façade 200 in the form a secondary cage structure comprising opposed side walls 210 and 220 connected by opposed end walls 230 and 240 and at least one pivotally connected partition wall 250. The façade 200 can accommodate a surface effect material 270 and comprises a material which permits viewing of the surface effect material when thus accommodated. Preferably, the end wall 230 of the façade 200 may define a cover panel that comprises a material which permits viewing of the surface effect material 270.

Figure 13B:
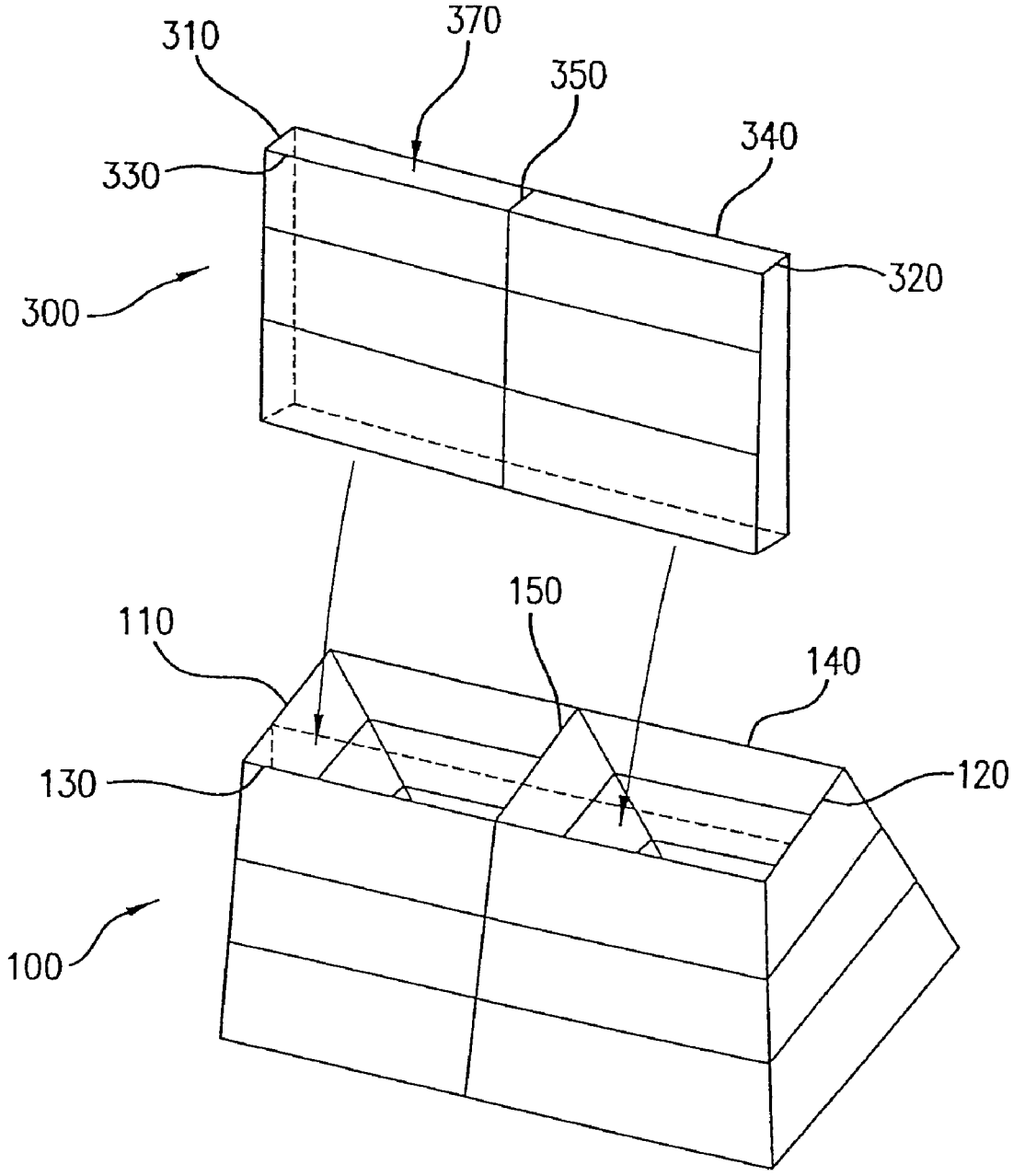
FIG. 13B shows, in perspective view, a multi-compartmental cage structure with an insert.

In another modification shown in FIG. 13B, the cage structure 100 further comprises an insert 300 in the form a secondary cage structure comprising opposed side walls 310 and 320 connected by opposed end walls 330 and 340 and at least one pivotally connected partition wall 350. The insert 300 can accommodate a surface effect material 370 and comprises a material which permits viewing of the surface effect material when thus accommodated. Preferably, the end wall 130 of the cage structure 100 and the end wall 330 of the insert 300 comprise a material which permits viewing of the surface effect material 370.

A further possible embodiment of the invention may be contemplated in which the panels are provided with integrally formed limbs. Each limb may have a return that can engage a part of the gabion. In use, a layer of decorative material such as turf is interposed between the gabion and the panel. The panel is pressed against the gabion causing the decorative layer to compress. The limb bends to pass a wire of the gabion. Releasing the panel allows the decorative layer to expand back to its original dimension thereby causing the return of the limb to engage a wire of the gabion. Limbs can be provided instead of the aforementioned hinge-engaging fasteners or supplementary thereto. Additionally or alternatively, one or more limbs may be disposed towards the centre of each panel to inhibit bowing-out of the panel in use, which adverse effect may occur over time, e.g., as grass/vegetation root systems establish.

Method of Industrial Application of the Invention

In this invention it is not necessary that the structures are erected in the factory. They could be erected on site, where some or all of the pivot connections are made, and the surface effect material could be inserted in the erected structure on site or it could be supplied between the support and cover panels and supplied as panel units.

The invention provides a means of adding to the functionality and/or the aesthetic appeal of a gabion structure. Thus, if it is desired to provide a gabion structure with an exterior surface effect for aesthetic reasons, this can be achieved by using a surface effect material with aesthetic properties. Alternatively, if it is desired to provide a gabion structure with an improved functionality (e.g., resistance to weathering, corrosion, heat expansion, water penetration and the like) then a suitable functional material can be selected as the surface effect material.

The invention provides that an outer surface on the side walls of the structure can be created by using a covering mesh panel, where such effects either visual and/or protective would not normally exist. The invention has particular application to the collapsible type structures discussed herein, and can be used to maintain the characteristics of the same in extreme environmental conditions by preventing expansion or contraction and hence improving the safety of the structures as required.

What is claimed is:

1. A gabion with a structure for creating an outer surface effect, comprising:

pivotally connected sidewalls and end walls, wherein at least one of the sidewalls or end walls comprises a surface effect structure comprising:

a support panel containing a wire mesh material;

a geo-textile material attached to said support panel;

a cover panel containing a wire mesh material; and a turf layer positioned between the support panel and the cover panel, wherein the cover panel is moveable with respect to the support panel to allow the positioning of the turf layer therebetween, and wherein the turf layer comprises soil bound by a woven material and wherein the soil contain seeds for a vegetation.

2. The gabion of claim 1, wherein the cover panel is moveable with respect to the support panel between a first position which permits insertion of the turf layer therebetween and a second position effective to retain the turf layer in place.

3. The gabion of claim 1, further wherein opposed side walls are connected by opposed end walls to define a cage cavity therebetween.

4. The gabion of claim 3, further comprising a bottom panel.

5. The gabion of claim 4, further comprising a top panel.

6. The gabion of claim 1, wherein an edge of the cover panel is connected to an edge of the support panel by a connector.

7. The gabion of claim 6, wherein the connector is in the form of elongated, coiled wire connector.

8. The gabion of claim 3, further comprising one or more partition walls between two opposite end walls.

9. The gabion of claim 8, wherein the one or more partition walls are mesh panels.

10. The gabion of claim 1, wherein the cover panel may be detached completely from the support panel.

11. The gabion of claim 1, wherein the support panel comprises a multi-panel wall.

12. The gabion of claim 1, wherein the support panel defines a side wall of the structure.

13. The gabion of claim 1, wherein the support panel defines an end wall of the structure.

14. The gabion of claim 1, wherein a second sidewall or end wall comprises the surface effect structure.

15. A gabion comprising:

at least two external panels, each such panel including:

a frame formed from a regular rectangular grid of regularly spaced apart vertical bars and horizontal bars, including terminal top and bottom horizontal bars and terminal left and right vertical bars, the frame having an inner face and an outer face;

at least two vertically spaced apart connecting means mounted on each of the left and right vertical bars, so as to be disposed substantially coplanar with the frame, the connecting means being of substantially uniform length, the vertical spacing being at least twice the length of the connecting means, the connecting means on the terminal left vertical bar being vertically indexed a predetermined distance, relative to the connecting means on the terminal right vertical bar, so as to enable two such external panels to be disposed adjacent to one another, with the connecting means of one external panel being interdigitated and vertically aligned with the connecting means of the adjacent external panel, to enable a connecting pin to be passed through the interdigitated connecting means to releasably fasten the external panels to one another.

16. A gabion comprising:

at least two external panels, each such panel including:

a frame formed from a regular rectangular grid of regularly spaced apart vertical bars and horizontal bars, including terminal top and bottom horizontal bars and terminal left and right vertical bars, the frame having an inner face and an outer face;

a plurality of vertically spaced apart connecting means mounted on each of the left and right vertical bars, so as to be disposed substantially coplanar with the frame, the connecting means being of substantially uniform length, the connecting means on the terminal left vertical bar being vertically indexed a predetermined distance, relative to the connecting means on the terminal right vertical bar, so as to enable two such external panels to be disposed adjacent to one another, with the connecting means of one external panel being interdigitated and vertically aligned with the connecting means of the adjacent external panel, to enable a connecting pin to be passed through the interdigitated connecting means to releasably fasten the external panels to one another.

* * * * *